United States Patent [19]

Schubert

[11] Patent Number: 4,573,030

[45] Date of Patent: Feb. 25, 1986

[54] SEALED RELAY STRUCTURE

[75] Inventor: Rudolf Schubert, Reynoldsburg, Ohio

[73] Assignee: AT&T Bell Laboratories, Murray Hill, N.J.

[21] Appl. No.: 566,653

[22] Filed: Dec. 29, 1983

[51] Int. Cl.[4] ..... H01H 7/16; H01H 1/66

[52] U.S. Cl. ..... 335/156; 335/129; 335/154

[58] Field of Search ..... 335/151, 154, 196, 156, 335/129, 135; 200/266; 422/78, 83

[56] References Cited

U.S. PATENT DOCUMENTS 3,720,798 3/1973 Kabayana et al. ..... 200/266

3,826,886 7/1974 Hara et al. ..... 200/266

OTHER PUBLICATIONS

"Organic Deposits on Precious Metal Contacts", *The Bell System Technical Journal,* May 1958, H. W. Hermance et al., pp. 739–776.

*Primary Examiner*—Harold Broome

*Attorney, Agent, or Firm*—Walter G. Nilsen

[57] ABSTRACT

Sealed relays often contain organic matter which reduce the conductivity of the electrical contacts. The invention is a sealed relay with a catalytic metal (Pd, Pt, Ni, Rh, Ir, Co, Fe, Os and Ru) on a rubbing surface which polymerizes the organic matter into a solid polymer that does not interfere with the electrical contacts.

7 Claims, 2 Drawing Figures

SEALED RELAY STRUCTURE

TECHNICAL FILED

The invention is a sealed relay structure.

BACKGROUND OF THE INVENTION

Sealed electrical relay form an important class of electrical devices extensively used in electronic devices, electrical networks, machine control, and the like. Since sealed electrical relay are not exposed to the outside atmosphere, failures due to corrosive atmosphere or oxidation are greatly reduced.

An important class of sealed electrical relay is the sealed LR relay. These devices often contain a number of electrical contact circuits and are controlled by magnetic circuits. The relays contain a variety of parts including electrical contact surfaces, spring assemblies, magnetic parts such as an armature and a cover which seals the electrical contacts and other parts from the outside atmosphere.

Often, many of the parts within the sealed contact device are made of organic substances such as plastics, polymers, sealants and lubricants which give off organic substances such as hydrocarbons which interfere with the operation of the electrical contacts. This problem has been discussed in some detail in a number of references including, "Organic Deposits on Precious Metal Contacts," by H. W. Hermance and T. F. Egan, *Bell System Technical Journal,* May 1958, pages 739—776.

It is highly advantageous to have sealed electrical relay that have long life, low resistance and high reliability. Often sealed relay that contain organic matter material such a sealing epoxy, wire insulation, lubricant, etc. develop high resistance electrical contacts that limit the life of the sealed contact. It is highly desirable to eliminate or minimize this limitation of performance and lifetime of sealed electrical relay.

SUMMARY OF THE INVENTION

The invention is a device comprising sealed electrical contacts which contain catalytic metal to polymerize organic matter (e.g., hydrocarbons) so as to prevent deposition of the organic matter on electrical contact surface and render the organic matter harmless. Catalytic metal is a material that catalyzes the polymerization of organic matter such as the platinum family of metals including Pd, Pt, Ni, Rh, Ir, Co, Fe, Ru and Os. The catalytic metal is preferably located where it will rub against a similar or like surface so as to promote polymerization of the organic matter into a substance of much lower vapor pressure (solid, wax, oil, etc.). Seal electrical contacts made in accordance with the invention have long life and low contact resistance.

DETAILED DESCRIPTION

The invention is based on the observation that hydrocarbons inside a sealed electrical relay structure can be eliminated as a source of trouble with the electrical contact surface by including in the sealed relay structure a catalytic metal that polymerizes the hydrocarbons into solid polymer substance. The catalytic metal can be any metal that catalyzes the polymerization of organic matter such as hydrocarbons. Typical catalytic metals are substances comprising palladium, platinum, iridium, rhodium, nickel, other platinum family members, etc. Catalytic metals may be alloys containing one or more of these metals or composite substances (e.g., particles embedded in plastic, thin films) containing one or more of these catalytic metals.

It should be recognized that the catalytic metal generally is not located at the electrical contact surface. Generally, the catalytic metal is located away from the electrical contact surface but inside the sealed envelope of the device. Preferred is a location where the catalytic metal surface is subjected to rubbing during the normal operation of the sealed electrical relay device. More preferred for convenience and efficiency is a structure where the catalytic metal is on two surfaces that rub together during normal operation of the relay.

Although the catalytic metal may be located anywhere in the sealed relay, other than the electrical contact area (so organic polymer does not interfere with the function of the contact structure), certain areas are preferred such as the armature and certain stationary parts near the armature such as the operating card, coil core and fixed contact assembly. Other places are the moving spring assembly, tub, armature assembly, etc.

An understanding of the invention would be facilitated by a description of a typical sealed relay assembly.

Figure 1:
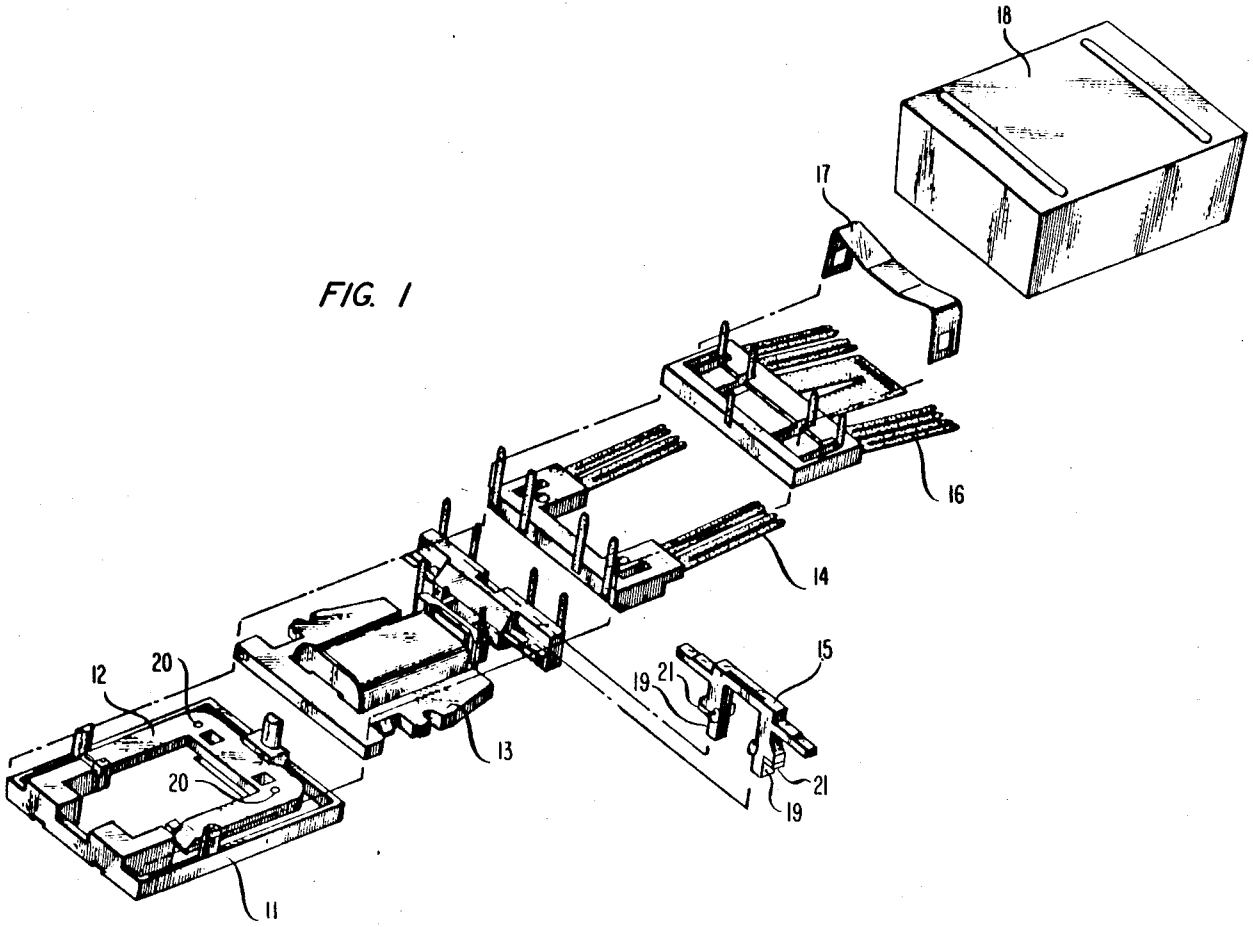
FIG. 1 shows in disassembled form the various parts of a typical sealed relay.

FIG. 1 shows an array 10 of parts for a typical sealed relay structure including the tub 11 with armature 12, coil-core and fixed contact assembly 13, make contact assembly 14, operating card 15, break contact and balance spring assembly 16, clamp 17 and cover 18. Althouth the catalytic metal can be located in a variety of places, the surfaces of the protruding surface near the bottom of the operating card 19 that contact the armature and the armature where the operating card contacts the armature 20 is particularly convenient. A small disk of catalytic metal is shown on the armature 12 at 20 and a small disk of catalytic metal shown on the operating card at 21. Often, the catalytic metal disk is put on both the operating card 15 and the armature 12 as shown.

Figure 2:
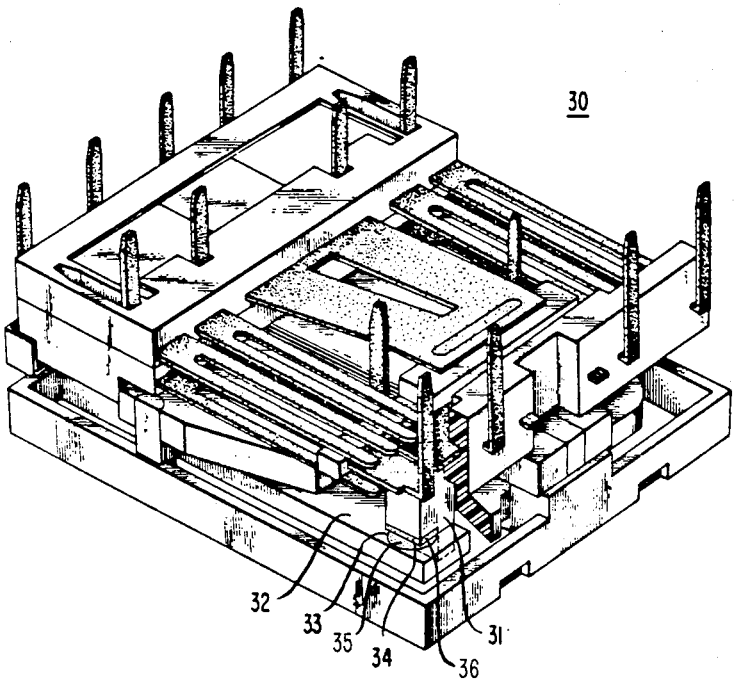
FIG. 2 shows in cut-away section the assembled relay.

FIG. 2 shows the assembled relay 30 with various parts including operating card 31 and armature. The catalytic metal 35 on the armature 33 and location of the surface 34 of the operating card where catalytic metal 36 is located are also shown.

What is claimed is:

1. A relay device comprising at least one sealed volume, said sealed volume comprising at least one electrical contact, operating card and armature each having a rubbing operating surface characterized in that the sealed volume further comprises catalytic metal capable of catalyzing the polymerization of organic matter into a solid polymer said catalytic metal located on the rubbing operating surface either on the operating card or armature.

2. The device of claim 1 in which the catalytic metal comprises at least one metal from the platinum family, said platinum family selected from the group consisting of Pd, Pt, Ni, Ir, Rh, Ru, Os, Co and Fe.

3. The device of claim 4 in which at least part of the catalytic metal is located on a surface that rubs against another surface during operation of the relay.

4. The device of claim 1 in which the sealed volume further comprises a tub with said armature, coil-core and fixed contact assembly, make contact assembly, break contact and balance spring assembly, said operating card, clamp and cover.

5. The device of claim 4 in which the catalytic metal is located on the operating card on the surface in contact with the armature.

6. The device of claim 5 in which catalytic metal is also located on the portion of the armature in contact with the operating card.

7. The device of claim 6 in which the catalytic metal is palladium.

* * * * *